US005660011A

United States Patent [19]

Bleeker et al.

[11] Patent Number: 5,660,011

[45] Date of Patent: Aug. 26, 1997

[54] SHOE FOR TOILET COMPARTMENT STILE

[75] Inventors: Raymond A. Bleeker, Norwalk; Frank Merriweather, Jr., Carson, both of Calif.

[73] Assignee: Bobrick Washroom Equipment, Inc., North Hollywood, Calif.

[21] Appl. No.: 614,971

[22] Filed: Mar. 11, 1996

[51] Int. Cl.[6] ..... F04H 1/00; A47K 3/16

[52] U.S. Cl. ..... 52/239; 52/244; 52/34; 24/295; 248/188.9; 312/351.3

[58] Field of Search ..... 52/34, 35, 239, 52/243, 244, 126.4, 737.6; 248/188.9; 24/173, 293, 295, 618, 615, 616; 312/351.1, 351.3; 108/186

[56] References Cited

U.S. PATENT DOCUMENTS

| | | | |
|---|---|---|---|
| 2,381,178 | 8/1945 | Munyon | 52/244 |
| 2,776,029 | 1/1957 | Hult | 52/239 X |
| 2,898,648 | 8/1959 | Bright | 24/293 X |
| 2,914,146 | 11/1959 | Conley | 52/126.4 |
| 3,053,354 | 9/1962 | Dielman | 52/244 X |
| 3,999,353 | 12/1976 | Dielman | 52/737.6 X |
| 4,996,811 | 3/1991 | Dull et al. | 52/126.3 X |
| 5,101,540 | 4/1992 | Roof et al. | 24/293 X |
| 5,347,690 | 9/1994 | Mansoor et al. | 24/295 |

FOREIGN PATENT DOCUMENTS

| | | | |
|---|---|---|---|
| 0208760 | 1/1957 | Australia | 24/295 |
| 1034679 | 6/1966 | United Kingdom | 24/295 |

OTHER PUBLICATIONS

Jacknob corp. catalog, Toilet Partition Hardware, Copyright 1988, front cover, index, p. 13.

Jacknob corp. catalog, Toilet Partition Hardware, Copyright 1995, front cover, index pp. 1, 18 and 19.

*Primary Examiner*—Carl D. Friedman
*Assistant Examiner*—Winnie Yip
*Attorney, Agent, or Firm*—Pretty, Schroeder & Poplawski

[57] ABSTRACT

A shoe for a toilet compartment stile comprising a single piece of metal having two sides and three ends folded into a rectangular shape with two of the ends overlapping each other and defining a stile space, with the shoe being flexible for moving the overlapping ends apart sufficiently to pass a stile therethrough and position the shoe around the stile, the sides having first and second inwardly turned pairs of flanges with the inner edges of the first pair of flanges spaced apart a first distance and with the inner edges of the second pair of flanges spaced apart a second different distance, and with the overlapping ends having aligned openings for receiving a fastener for joining the overlapping ends together. A clip for joining the overlapping ends of the shoe and comprising a single piece of metal having a U-bend with inner and outer arms with a tab carried on and projecting at an angle to the inner arm, with the clip arms having flanges for engaging the overlapping end aligned openings for retaining the clip on the ends without the fastener.

13 Claims, 3 Drawing Sheets

FIG. 7
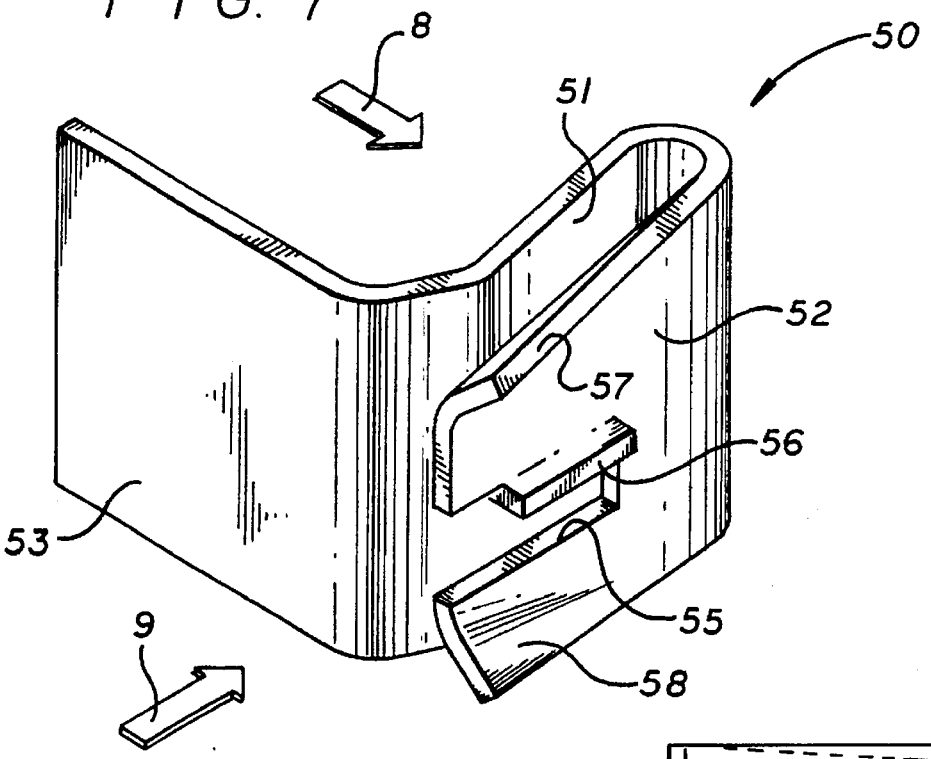
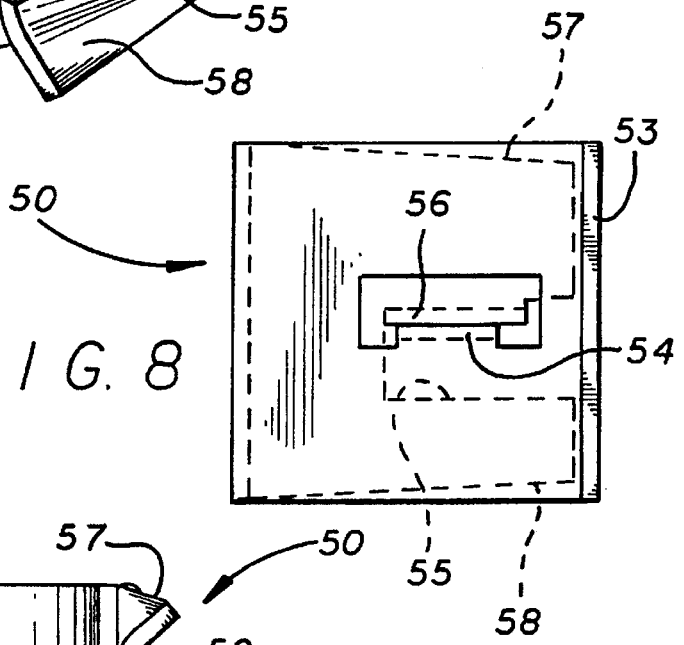
FIG. 8
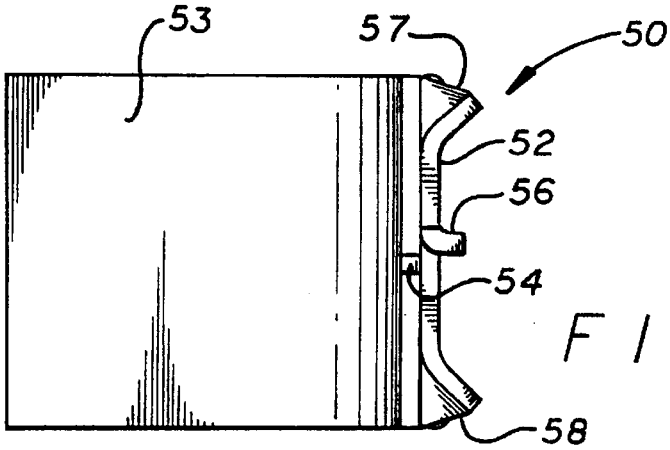
FIG. 9

SHOE FOR TOILET COMPARTMENT STILE

BACKGROUND OF THE INVENTION

This invention relates to toilet compartments and in particular to a new and improved shoe for a toilet compartment stile.

A conventional toilet compartment 11 with stiles 12, 13, door 14 and side panel 15 is shown in FIG. 1. The stiles 12, 13 are fastened to the floor in a conventional manner as shown in FIG. 2. The side panel 15 is connected between the stile 12 and the back wall. 17 with conventional mounting brackets. The stile 13 is similarly fastened to the side wall 18. The door 14 is hinged to the stile 13 in the conventional manner.

FIG. 2 illustrates the conventional mounting of a stile on the floor of the toilet compartment. A bracket 20 is attached to the bottom of the stile 13 by bolts 21 and nuts 22 positioned in openings 23 at the lower end of the stile. Bolts 24 are set in the floor 16 and are positioned in slots in the bracket 20. Conventional nuts With washers are positioned on the bolts 24 above and below the bracket 20 for clamping the bracket and the stile in place on the floor, as shown in FIG. 3. After the stile is clamped to the floor, a shoe 25 is slid downward over the stile to rest on the floor and enclose the lower end of the stile, the mounting bolts 21 and 24, and associated components.

The conventional shoe is made of one piece or of two pieces welded together, with a specific length and a specific width for a specific size of stile. Typically, stiles come in a wide range of lengths, typically ranging from two inches to twenty-four inches. Also stiles usually come in two widths or thicknesses, typically three-quarter inch and on inch. This requires manufacture and stocking of a substantial number of different sizes of shoes. Also, it is sometimes necessary to place the shoe in position after the stile has been attached to the wall or the side panel, at which time the shoe can no longer be slid downward over the stile.

Several approaches have been considered in overcoming these disadvantages of the one piece stile construction. In one design, the shoe has been folded from a single piece of metal with overlapping ends at one end so that the shoe can be opened for laterally sliding onto the stile, with the overlapping ends then joined by a screw which also runs into the stile to hold the shoe in position. This design still requires a different shoe for each length and for each stile thickness.

Another approach has been to produce a shoe in four pieces, with the end pieces being channels and the side pieces being flat. Channels can be provided for two thicknesses of the stile, and sides can be provided in various widths. However, this construction requires ordering the appropriate parts for each installation and assembly of the components, usually on the site.

Another approach is a two piece construction with a three sided unit having flanges for attaching a fourth side after the three sided unit has been positioned around the stile. Here again a different three sided unit must be provided for each stile thickness and stile width.

It is an object of the present invention to provide a new and improved shoe for a stile, which shoe can be installed by positioning around the stile with a lateral movement, and which shoe can be utilized with stiles of two different thicknesses. A further object of the invention is to provide such a shoe which can be utilized with free standing stiles and also with stiles mounted against a wall. With the new and novel shoe construction of the invention, the number of shoe widths which must be stocked is reduced by half.

Other objects, advantages, features and results will more fully appear in the course of the following description.

SUMMARY OF THE INVENTION

The invention includes a shoe for a toilet compartment stile comprising a single piece of metal having two sides and three ends folded into a rectangular shape with two of the ends overlapping each other and defining a stile space, with the shoe being flexible for moving the overlapping ends apart sufficiently to pass a stile therethrough and position the shoe around the stile, with the sides having first and second inwardly turned pairs of flanges with the inner edges of the first pair of flanges spaced apart a first distance and with the inner edges of the second pair of flanges spaced apart a second different distance. The overlapping ends have aligned openings for receiving fastener means for joining the overlapping ends together.

The invention further includes a clip for joining the overlapping ends of the shoe, with the overlapping ends having aligned openings for receiving fastener means for joining the over lapping ends together, with the clip comprising a single piece of metal having a U-bend with inner and outer arms with a tab carried on and projecting at an angle to the inner arm, with the clip arms having means for engaging the overlapping and aligned openings for retaining the clip on the ends without the fastener means.

BRIEF DESCRIPTION OF THE DRAWINGS

FIG. 7 an enlarged perspective view of the clip 50 of FIGS. 4 and 6;

FIG. 8 is a side view taken along the arrow 8 of FIG. 7, and

Figure 1:
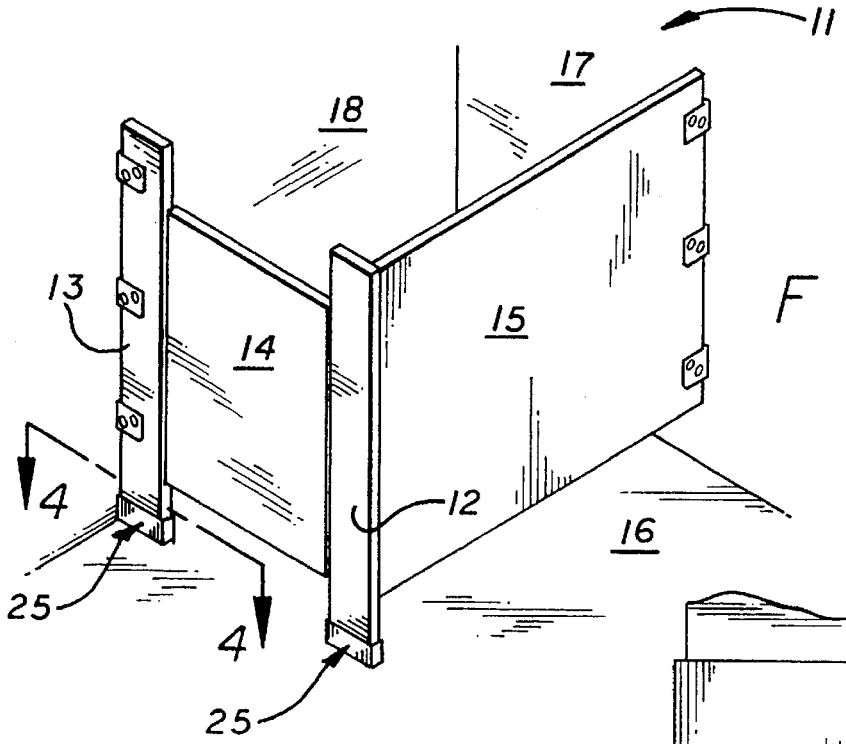
FIG. 1 is a perspective view illustrating a typical toilet compartment with stiles and shoes.
Figure 2:
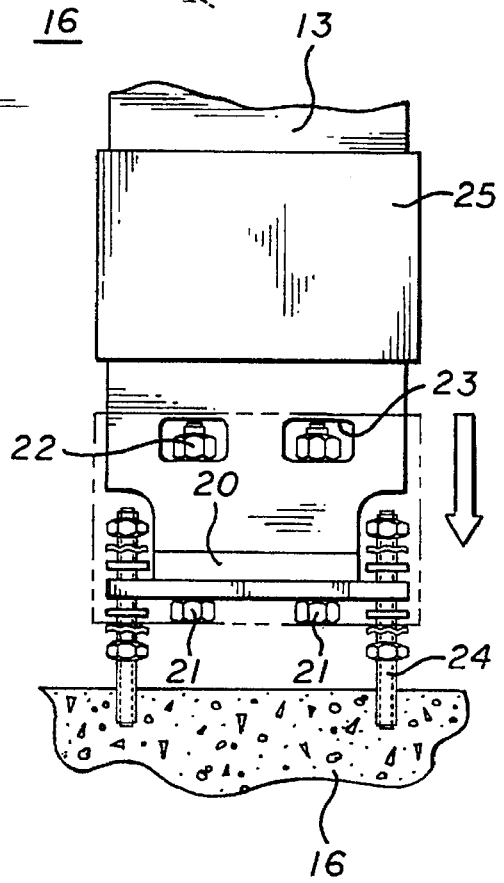
FIG. 2 PRIOR ART
FIG. 2 is an enlarged exploded view illustrating conventional mount of a stile on a floor with a prior art shoe.
Figure 3:
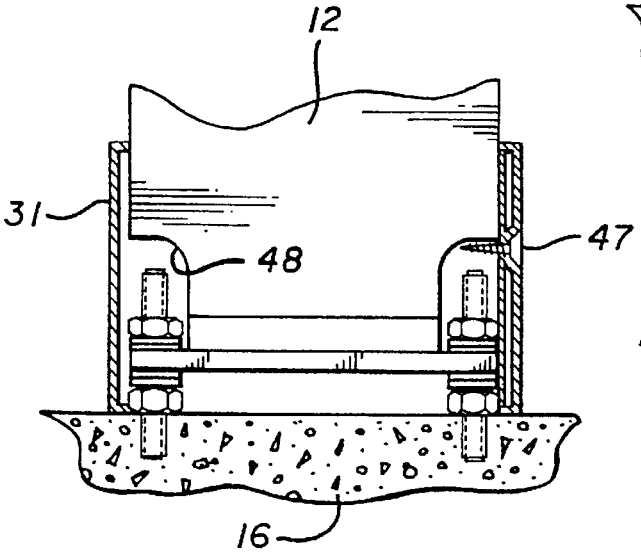
FIG. 3 is a view similar to that of FIG. 2 illustrating mounting with a shoe incorporating the features of the present invention.

9 is a side view taken along the arrow 9 of FIG. 7.

DESCRIPTION OF THE PREFERRED EMBODIMENT

The shoe 31 of the invention is folded from a single piece of metal with sides 32, 33, end 34, and overlapping ends 35, 36. The shoe also has a first pair of inwardly turned flanges 37, 38 and a second pair of inwardly turned flanges 39, 40 on the respective sides 32, 33. The inner edges of the flanges 37, 38 are spaced apart a first distance, to provide for one thickness of stile, and the inner edges of the flanges 39, 40 are spaced apart a lesser thickness to provide for a thinner stile. Typically, the stile thickness dimensions are one inch and three-quarters of an inch.

Figure 4:
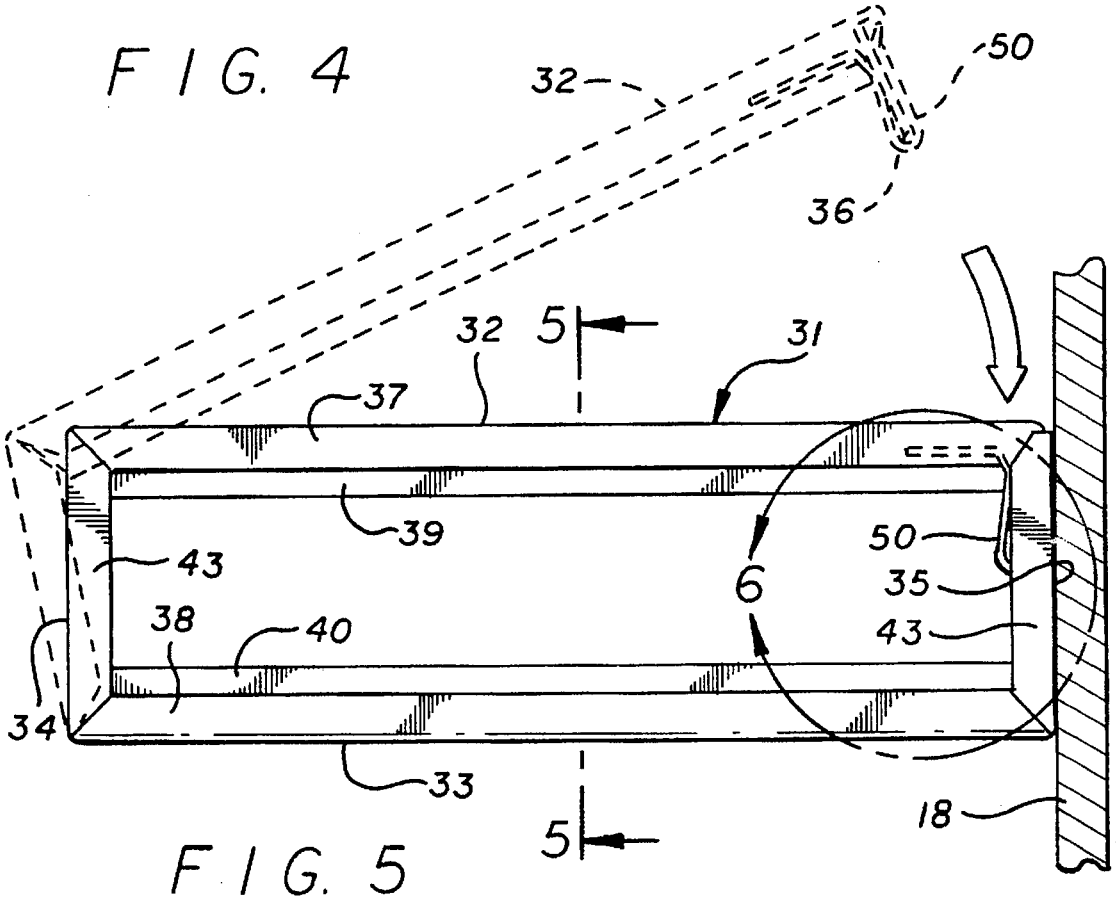
FIG. 4 is an enlarged partial sectional top view taken along the line 4—4 of FIG. 1.
Figure 5:
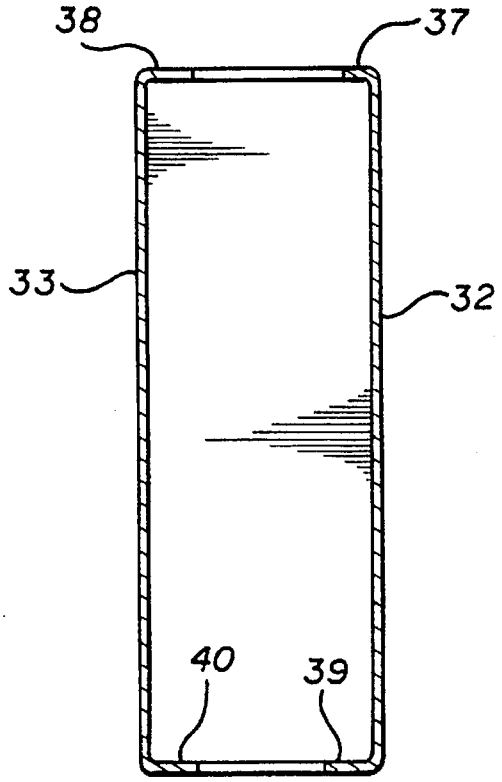
FIG. 5 is an enlarged sectional view taken along the line 5—5 of FIG. 4.

The shoe is installed about the stile by spreading the shoe apart as shown in phantom lines in FIG. 4 and then bringing the ends 35, 36 into overlapping relation as shown in solid lines in FIG. 4. When installed in this manner, the lower flanges rest on the floor below the lower end of the bracket and the upper flange define the space for the stile. With this construction, the shoe can be installed either with the flanges 37, 38 at the upper side for a thicker stile or with the flanges 39, 40 at the upper side for a thinner stile. Preferably, flanges 43 may be provided at the ends also, normally with these flanges of the same size for both top and bottom.

In the preferred construction illustrated, a depressed portion 45 is provided in the flange 35, and a recessed portion 46 is provided in the flange 36, with aligned openings in the two portions for a fastener for joining the ends 35, 36 together. Typically, the fastener is a sheet metal screw 47 which engages both ends. However, this screw does not have to go into the stile, but rather the components are dimensioned so that the inner end of the screw fits below the notch 48 at the lower end of the stile. The head of the screw is positioned in the depressed portion 45 to provide a smooth external surface.

Figure 6:
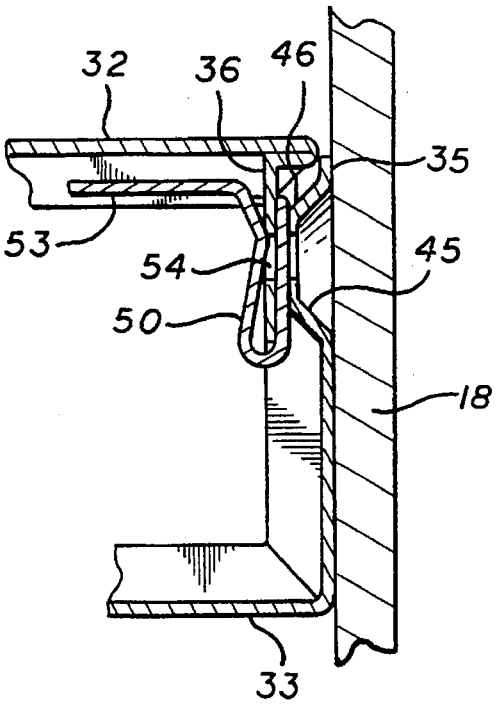
FIG. 6 an enlarged partial view taken at the circle 6 of FIG. 4.

This installation is satisfactory for a stile which does not abut a wall, such as the stile 12, where there is access for overlapping the ends and inserting the screw. However, a different construction is desired for a stile which abuts a wall, such as the stile 13. For this type of installation, the overlapping ends are positioned at the wall, as shown in FIG. 4 and there is no access for utilizing a screw type fastener. For this type of installation, a clip 50 is utilized, with the clip initially positioned on the end 36. The shoe is positioned about the stile in the open condition as shown in phantom lines in FIG. 4. Then the side 32 is moved to the solid line position of FIG. 4, bringing the clip 50 into the position of FIG. 6. The clip is provided with means for attaching the clip to the end 36 and also for attaching the clip to the end 35, thereby maintaining the two sides of the shoe in the latched position about the stile.

The clip 50, as better seen in FIGS. 7–9, is formed from a single piece of metal, with a U-bend having an inner arm 51 and an outer arm 52, with a tab 53 carried on and projecting at an angle from the inner arm 51. A shoulder 54 is provided in the inner arm, with the shoulder projecting toward the outer arm. Another shoulder 56 is provided in the outer arm, typically by bending up a portion of the arm at a slot 55, with the shoulder projecting away from the inner arm. Preferably, guide wings 57, 58 are provided at opposite edges of the outer arm.

In use, the clip is positioned on the inner overlapping end 36 of the shoe, as shown in FIG. 4, with the tab 53 providing for manual positioning of the clip. With the clip in this position, the shoulder 54 fits into the fastener opening in the recessed portion 46 of the inner end, maintaining the clip in position on the inner end. Then as the shoe inner end 36 is slid into position against the shoe outer end 35 to the position of FIG. 6, the shoulder 54 of the outer arm of the clip engages the fastener opening in the depressed portion 45 of the outer end, locking the overlapping ends together. The wings 57, 58 of the clip serve to guide the clip in position around the depressed portion 45.

This construction enables the shoe to be installed and maintained in position when the stile is against a wall or other structure which does not provide access for inserting a screw. Thus, it is seen that the aims of the invention are achieved with this unique shoe and clip.

We claim:

1. A shoe for a toilet compartment stile comprising a single piece of metal having two sides and three ends folded into a rectangular shape with two of said ends overlapping each other and defining an enclosed stile space, said shoe being flexible for moving said overlapping ends apart to increase the size of sad stile space for sufficiently passing a stile between said ends thereby permitting positioning of said shoe around the stile, said sides having first and second inwardly turned pairs of flanges at 90 degrees, with inner edges of said first pair of flanges spaced apart a first distance and with inner edges of said second pair of flanges spaced apart a second different distance and fastener means for joining said overlapping ends together.

2. A shoe as defined in claim 1 with said ends having inwardly turned flanges.

3. A shoe as defined in claim 1 wherein said overlapping ends have aligned openings for receiving said fastener means for joining said overlapping ends together.

4. A shoe as defined in claim 3 wherein said overlapping ends comprise an inner end and an outer end, with said outer end having a depressed portion for receiving a fastener head and said inner end having a recessed portion for receiving said depressed portion.

5. A shoe for a toilet compartment stile comprising a single piece of metal having two sides and three ends folded into a rectangular shape with two of said ends overlapping each other and defining an enclosed stile space, said shoe being flexible for moving said overlapping ends apart to increase the size of said stile space for sufficiently passing a stile between said ends thereby permitting positioning of said shoe around the stile, said sides having first and second inwardly turned pairs of flanges with the inner edges of said first pair of flanges spaced apart a first distance and with the inner edges of said second pair of flanges spaced apart a second different distance, a clip for joining said overlapping ends of said shoe, with said overlapping ends having aligned openings, said clip comprising a single piece of metal having a U-bend with inner and outer arms with a tab carried on and projecting at an angle to said inner arm, said clip arms having means for engaging said overlapping end aligned openings for retaining said clip on said ends for locking said overlapping ends together.

6. A shoe as defined in claim 5 wherein said clip arms means for engaging includes a first shoulder on said inner arm projecting toward said outer arm and a second shoulder on said outer arm projecting away from said inner arm, with said clip sliding onto the inner of said overlapping ends, and with said shoulders in alignment for engaging said aligned openings of said inner and outer ends, respectively.

7. A-shoe as defined in claim 6 wherein the outer overlapping end of said shoe has a depressed fastener head portion and said outer arm of said clip has opposed outward turned guide wings for positioning said clip about said depressed fastener head portion of said shoe outer overlapping end.

8. A clip for a shoe for a toilet compartment stile, the shoe having sides and ends with two ends overlapping each other and with the shoe being flexible for moving the overlapping ends apart sufficiently to pass a stile therethrough and position the shoe around the stile, with the overlapping ends having aligned openings for receiving fastener means for joining the overlapping ends together, said clip comprising a single piece of metal having a U-bend with inner and outer arms with a tab carried on and projecting at an angle to said inner arm, said clip arms having means for engaging the shoe overlapping end aligned openings for retaining said clip on the shoe ends without the fastener means.

9. A clip as defined in claim 8 wherein said clip arms means for engaging includes a first shoulder on said inner arm protecting toward said outer arm and a second shoulder on said outer arm projecting away from said inner arm, with said clip sliding onto the inner of the shoe overlapping ends, and with said shoulders in alignment for engaging the shoe aligned openings of the inner and outer ends, respectively.

10. A clip as defined in claim 9 wherein said outer arm of said clip has opposed outward turned guide wings for positioning said clip about a depressed fastener head portion in the shoe outer overlapping end.

11. A shoe for a toilet compartment stile comprising a single piece of metal having two sides and three ends folded into a rectangular shape with two of said ends overlapping each other and defining an enclosed stile space, said shoe being flexible for moving said overlapping ends apart to increase the size of said stile space for sufficiently passing a stile between said ends thereby permitting positioning of said shoe around the stile, with said overlapping ends having aligned openings, and a clip comprising a single piece of metal having a U-bend with inner and outer arms with a tab carried on and projecting at an angle to said inner arm, said clip arms having means for engaging said overlapping end aligned openings for retaining said clip on said ends for locking said overlapping ends together.

12. A shoe as defined in claim 11 wherein said clip arms means for engaging includes a first shoulder on said inner arm projecting toward said outer arm and a second shoulder on said outer arm projecting away from said inner arm, with said clip sliding onto the inner of said overlapping ends, and with said shoulders in alignment for engaging said aligned openings of said inner and outer ends, respectively.

13. A shoe as defined in claim 12 wherein said outer arm of said clip has opposed outward turned guide wings for positioning said clip about a depressed fastener head portion of said shoe outer overlapping end.

* * * * *